United States Patent [19]

Mabuchi

[11] 4,260,041

[45] Apr. 7, 1981

[54] TOY ENERGY SUPPLY DEVICE

[75] Inventor: Kenichi Mabuchi, Matsudo, Japan

[73] Assignee: Mabuchi Motor Co. Ltd., Tokyo, Japan

[21] Appl. No.: 12,007

[22] Filed: Feb. 14, 1979

[30] Foreign Application Priority Data

Feb. 17, 1978 [JP] Japan ..... 53-19256[U]

[51] Int. Cl.[3] ..... F03G 1/00

[52] U.S. Cl. ..... 185/40 R; 46/206; 185/40 H; 185/43; 185/44; 185/DIG. 1; A63H/29/24

[58] Field of Search ..... 185/40 R, 40 H, 43, 185/44, DIG. 1; 46/206, 209

[56] References Cited

U.S. PATENT DOCUMENTS

| | | | |
|---|---|---|---|
| 2,731,765 | 1/1956 | Carver | 46/209 X |
| 3,471,963 | 10/1969 | Tomiyama | 46/209 X |
| 3,732,949 | 5/1973 | Williams | 185/DIG. 1 X |

FOREIGN PATENT DOCUMENTS

| | | | |
|---|---|---|---|
| 691386 | 7/1930 | France | 185/40 R |

*Primary Examiner*—Allan D. Herrmann

[57] ABSTRACT

An energy supply device for supplying a predetermined amount of energy by means of rotating rollers driven by an electric motor to a power toy driven by elastic materials is disclosed.

3 Claims, 6 Drawing Figures

TOY ENERGY SUPPLY DEVICE

BACKGROUND OF THE INVENTION

1. Field of the Invention

This invention relates generally to a toy energy supply device, and more specifically to a toy energy supply device in which power driven rollers are caused to rotate to supply a predetermined amount of energy to a power toy driven by elastic materials.

2. Description of the Prior Art

Heretofore, micromotors and flat spiral springs have been used as prime movers of toys. Micromotors, however, are too expensive to be used in a power toy while flat spiral springs, when broken, cannot be easily replaced by a user and therefore have to be discarded. In addition, either of them is too large in size to be incorporated in a small toy such as a miniature car. The applicant therefore separately suggests a small toy such as a miniature car. The miniature car suggested by the applicant has a multi-stage energy storage portion using gears since an energy storage portion consisting of a single rubber band is insufficient to drive even a miniature car. However, in order to store energy sequentially in rubber bands constituting each stage of the multi-stage energy storage portion while overcoming friction between gears and friction between hooks constituting an energy transmitting means, the gear ratio of 1 is not sufficient, but the gear ratio on the order of 1.04–1.43, more particularly 1.06–1.20, is required. Furthermore, in order to accumulate an appropriate amount of energy, three or four stages of energy storage portions are required. In view of the fact that it is quite troublesome to store energy in this type of miniature car by manually rotating small rear wheels, this invention is intended to store a predetermined amount of energy in a toy powered by elastic materials using an extremely simple means.

SUMMARY OF THE INVENTION

It is an object of the present invention to provide a toy energy supply device for storing energy in a power toy driven by elastic materials.

It is another object of the present invention to provide a toy energy supply device in which an electric energizing means is employed to store energy in a power toy.

It is still another object of the present invention to provide a toy energy supply device having a stopping means to turn on and off the electric energizing means so that a predetermined amount of energy is stored in the energy storage portion of the power toy.

DETAILED DESCRIPTION OF THE EMBODIMENT

Figure 1:
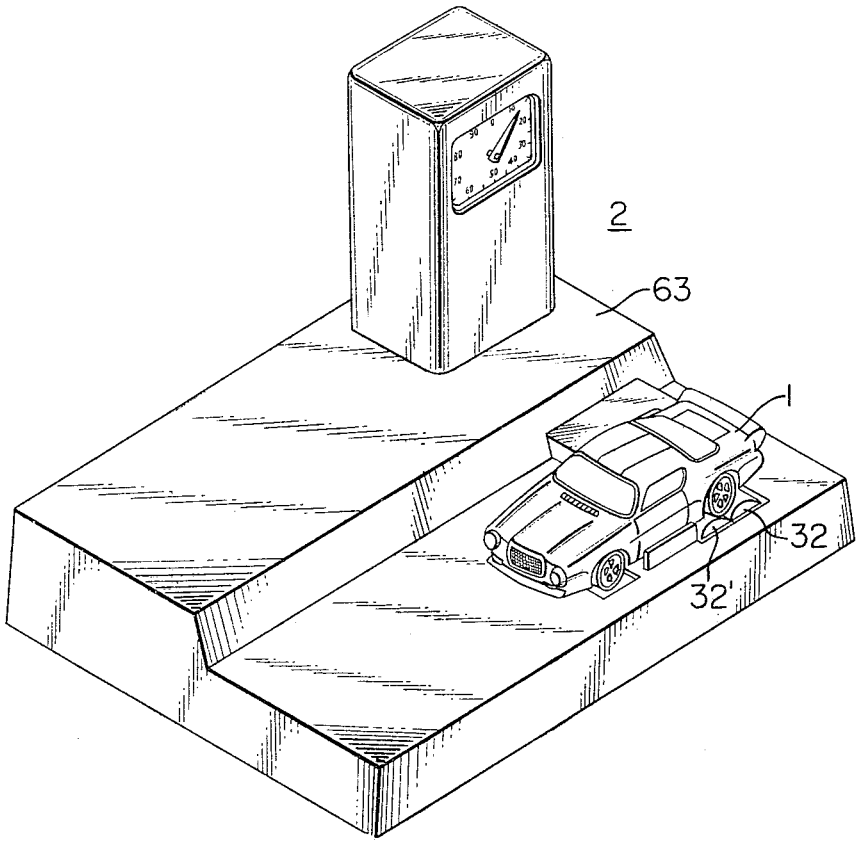
FIG. 1 illustrates an energy supply device embodying this invention and a miniature car receiving energy therefrom.

In FIG. 1, numeral 1 refers to a miniature car and 2 to an energy supply device according to this invention, which will be described in detail later.

First, the miniature car 1 in which energy is stored by the toy energy supply device of this invention will be described.

Figure 2:
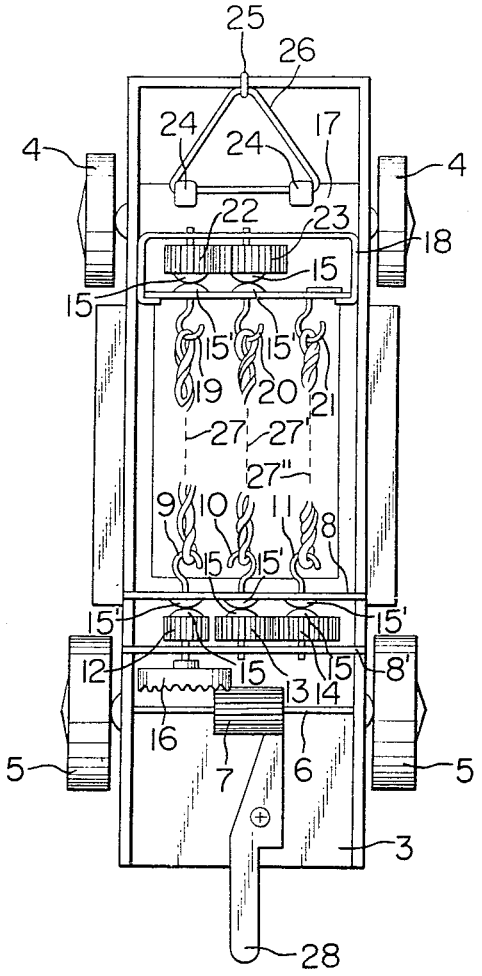
FIGS. 2 and 3 show the typical construction of the multi-stage energy storage device provided inside the miniature car.
Figure 3:
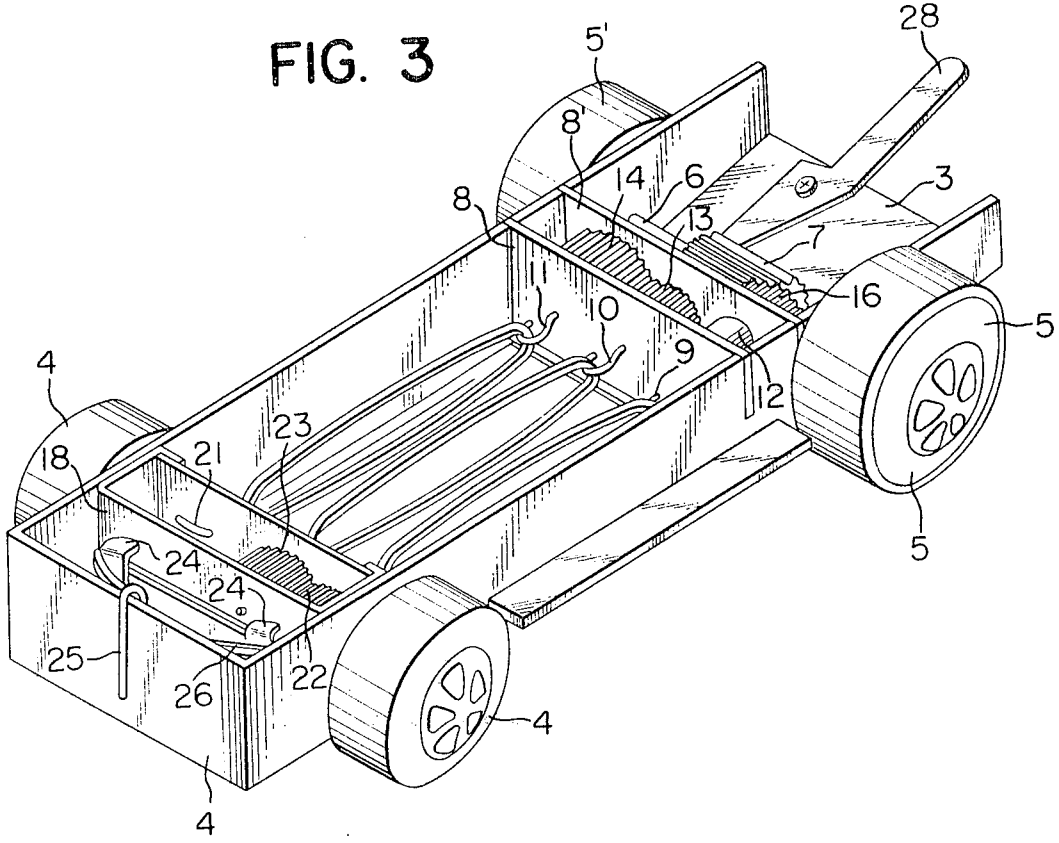

As shown in FIGS. 2 and 3, the miniature car 1 has a chassis frame 3 on the inside and the chassis frame 3 rotatably supports front wheels 4 and 4 and rear wheels 5 and 5. A pinion gear 7 is fixed to a shaft 6 to which the rear wheels 5 and 5 are connected. Numerals 8 and 8' refer to partitioning plates fitted to the chassis frame 3, on which a plurality of, for example three hooks 9, 10 and 11 are rotatably supported. To the hook 9, a thrust bearing metal support 12 is fixed, and to the hooks 10 and 11, gears 13 and 14 are fixed. Numerals 15 and 15' refer to metal thrust bearings constituting bearings for reducing friction loss. A crown gear 16 is fixed to the rear end of the hook 9 and is in mesh with the pinion gear 7. On the chassis frame 3, a movable plate 17 is fitted. The movable plate 17 has a frame 18 on which hooks 19, 20 and 21 are supported, the hooks 19 and 20 being rotatably supported and the hook 21 being fixedly supported. Gears 22 and 23 are fixed to the hooks 19 and 20, respectively. The metal thrust bearings 15 and 15' are provided on the gears 22 and 23 and the frame 18 to reduce friction loss.

A pair of projections 24 and 24 are formed on the movable plate 17, and a tensioner, for example a rubber band 26 is stretched between the projections 24 and 24 and a clip 25 fixed to the chassis frame 3.

Rubber bands 27, 27' and 27'' are stretched between the hooks 9, 10 and 11 and the hooks 19, 20 and 21, respectively. Numeral 28 refers to a stopper for locking the crown gear 16 to prevent the crown gear 16 from being rotated by engaging with the pinion gear 7. When the stopper 28 is disengaged from the pinion gear 7 and the rear wheels 5 and 5 are caused to rotate, the rotating force rotates the hook 9 via the pinion gear 7 and the crown gear 16 to cause the rubber band 27 to twist. This causes the hook 19 to twist, rotates the hook 20 of the next stage via the gears 22 and 23, and causes the rubber band 27' to twist. In this way, energy is stored in the rubber bands 27, 27' and 27'' of each stage by continuously rotating the rear wheels 5 and 5. The ratio of the gears 22 and 23 and that of gears 13 and 14 are adapted to be more than 1. This is to overcome the problem of insufficient and uneven storage of energy in rubber bands at the gear ratio of less than 1. By increasing the gear ratio to more than 1, the torque for transmitting energy to the succeeding stages can be increased, resulting in uniform storage of energy in rubber bands of each stage. Since the rubber band 26 serving as a tensioner pulls the movable plate 17, the rubber bands 27, 27' and 27'' receive twisting force in a constantly tensioned state, resulting in uniform storage of energy in the rubber bands and uniform release of the stored energy.

Now assume that the ratios of the gears 22 and 23 and the gears 13 and 14 are set to 1.0:1.2 and each of the rubber bands is uniformly twisted by 60 turns to give a total of 180 turns of twisting energy to three stages of the rubber bands 27, 27' and 27''. When the gear ration is 1:1 and there is no friction loss, it is sufficient to rotate the hook 9 by 180 turns to store twisting energy in the rubber bands 27, 27' and 27''. At the gear ration of 1:1.2, however, the hook 9 has to be rotated by 218.4 turns ($60+60\times1.2+60\times1.2\times1.2=218.4$). That is, the hook 9 has to be rotated 0.2% more at the gear ratio of 1:1.2 ($218\div180=1.21$). The more the number of stages is increased, the more the hook 9 has to be rotated due to the gear ratio. Moreover, it is difficult, particularly for children, to rotate the small wheels of a miniature car by hand. This invention provides an apparatus which makes this operation easy. In the following, an embodiment of this invention will described, referring to FIGS. 4, 5 and 6.

In the figures, numeral 30 refers to a base to which a supporting frame 31 is fixed. Numerals 32 and 32' refer to rollers rotatably supported by a supporting arm 33 pivotally supported by the supporting frame 31. A housing 34 is fixed to the supporting arm 33. Numeral 35 refers to a small electric motor, such as a micromotor, which is constructed so as to rotate the rollers 32 and 32' via a pinion gear 37 which is interlocked with the rotor of the small motor 35. In its normal state, the supporting arm 33 is kept lifted upward by a formed wire spring 38. The housing 34 is fixed to the supporting arm 33. At the lower part of the housing 34, a movable contact (not shown) which is constructed so as to come into contact with a fixed contact 39 which is provided on one end of a conductor 40. The other end 41 of the conductor 40 is bent upward, the tip thereof forming a fixed contact 42. A movable contact piece 43 collaborating with the fixed contact 42 is provided on an insulating support 44 provided on the base 30. Numerals 45, 45', 46, 47, 48 and 49 refer to gears; 60 to a shaft; 50 to a worm gear. Numeral 51 refers to a gear constructed so as to rotate together with a lever 52. Numeral 53 refers to a shaft to which the worm gear 50 is fixed, and at one end of which a small pulley 54 is fixed. The small pulley is constructed so as to rotate a large pulley 55 by means of a belt 58. Numerals 56 and 57 refer to lead wires.

Now assume that the rear wheels 5 and 5' of the miniature car 1 are placed on between the rollers 32 and 32', as shown in FIG. 1, and pushed downward. By doing this, the supporting arm 33 is swinged downward around the shaft 59, resisting the formed wire spring 38. As the supporting arm 33 is moved downward, the housing 34 also moves downward, causing the movable contact (not shown) to come into contact with the fixed contact 39. Thus, a closed circuit from a battery 36 via the lead wire 56, the micromotor 35, the movable contact, the fixed contact 39, the conductor 40, the fixed contact 42, the movable contact 43 and the lead wire 57 to the battery 36 is formed, causing the micromotor 35 to rotate. As the micromotor 35 rotates, the pinion gear 37 also rotates and the gears 45 and 45' in mesh with the pinion gear 37 also rotates, thus causing the rollers 32 and 32' fixed to the rotating shaft of the gears 45 and 45' to rotate. Since the rollers 32 and 32' are rotated at the same rate, the rear wheels 5 and 5' placed on between the rollers 32 and 32' are efficiently rotated. Thus, energy can be very easily stored in two or more stages of the rubber bands 27, 27' and 27''.

Figure 5:
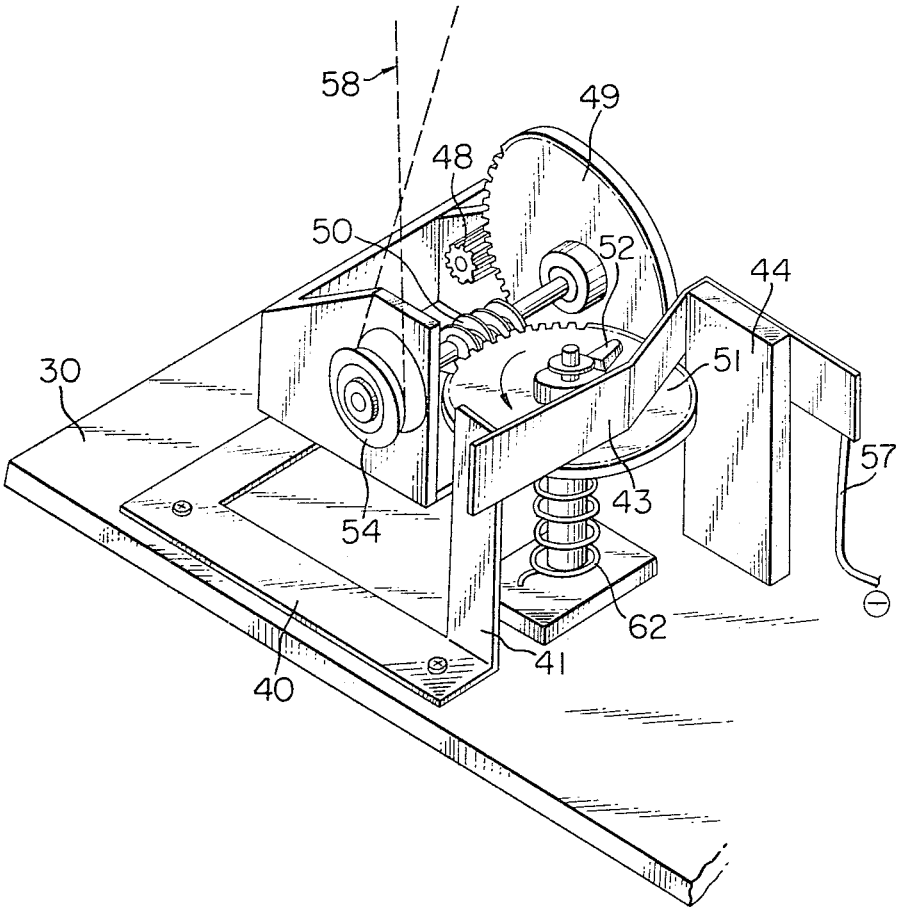
FIGS. 5 and 6 are partial views illustrating the timer mechanism of the energy supply device according to this invention.
Figure 6:
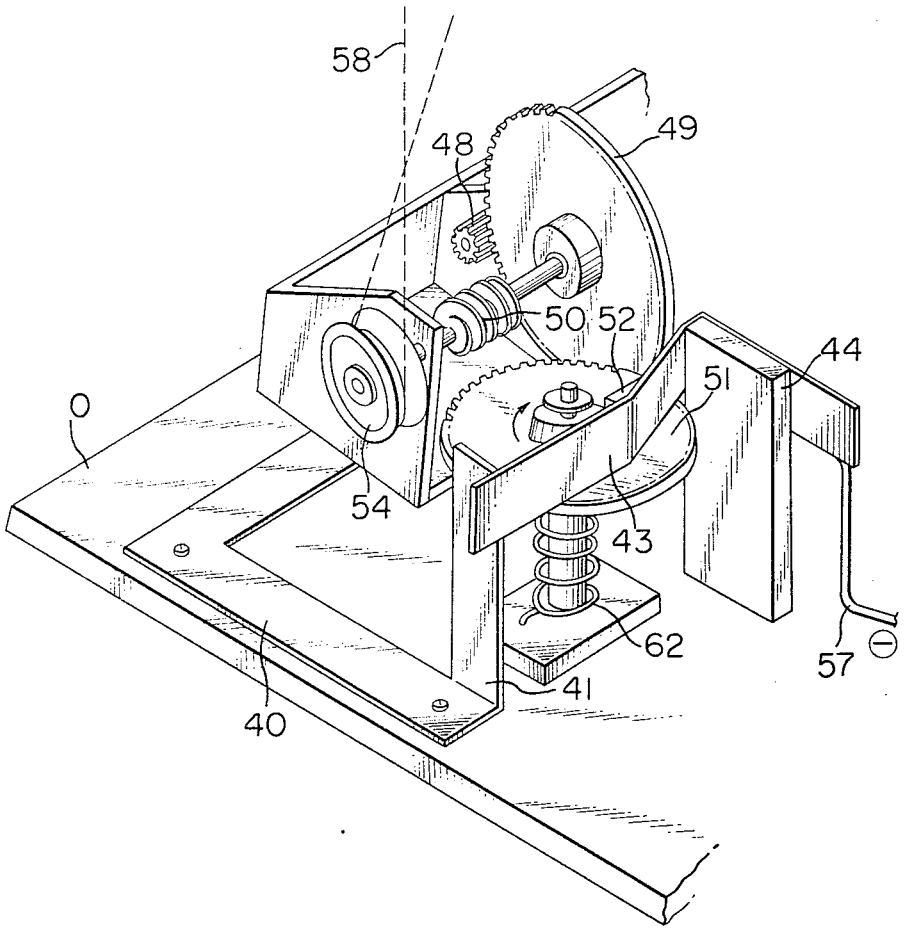

As shown in FIG. 5, the worm gear 50 is disposed so as to come into mesh with the gear 51 when the housing 34 is lowered. Therefore, the micromotor 35 causes the gear 51 to rotate via the gear 46 fixed to the same shaft of the gear 45, the gear 47 in mesh with the gear 46, the shaft 60, the gears 48 and 49, the shaft 53 and the worm gear 50. As the gear 51 is rotated, the lever 52 simultaneously rotates and the tip of the lever 52 pushes the movable contact piece 43 after a given time, opening electrical connection between the movable contact piece 43 and the fixed contact 42. Thus, the circuit between the micromotor 35 and the battery 36 is opened to stop the micromotor 35.

Figure 4:
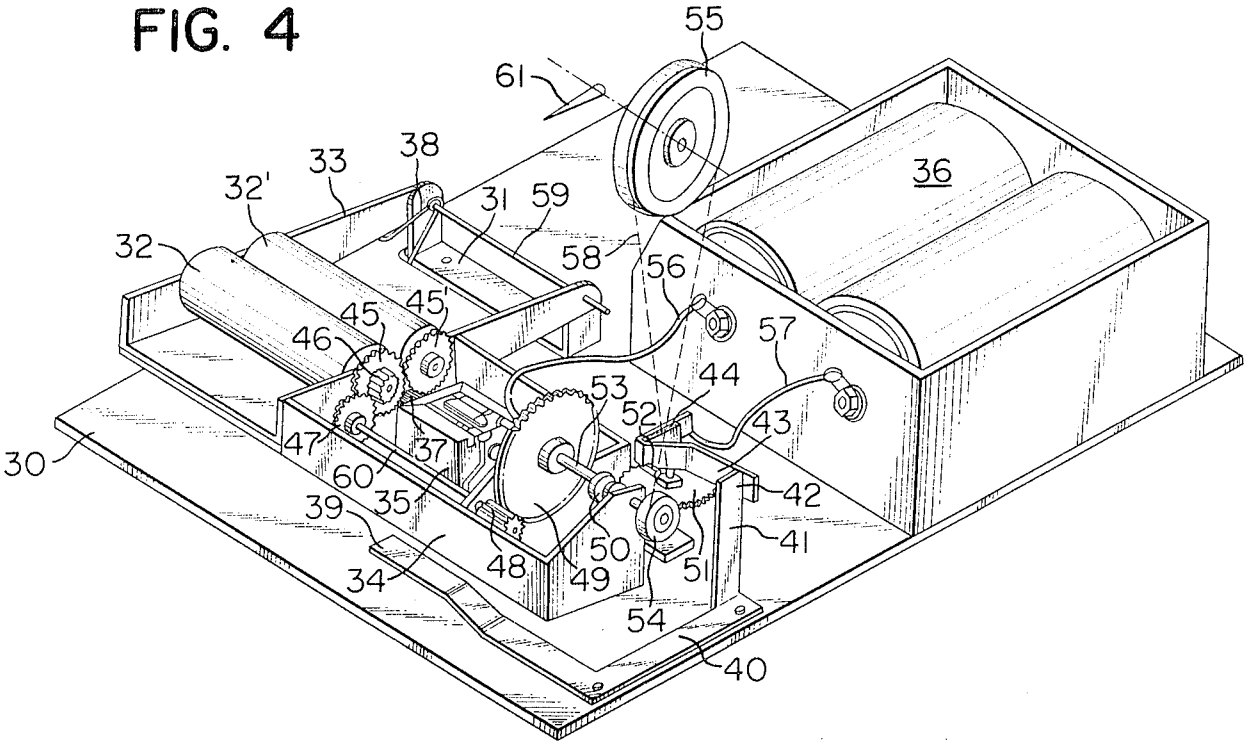
FIG. 4 shows the internal construction of the energy supply device according to this invention.

Meanwhile, as the micromotor 35 rotates, the small pulley 54 also rotates, causing the large pulley to rotate via the rubber belt 58. Since a pointer 61 is fixed to the shaft of the large pulley 55, the pointer 61 also rotates while the micromotor 35 rotates. Therefore, when the mechanism shown in FIG. 4 is housed in a case 63 as shown in FIG. 1, the rotation of the pointer 61 gives the impression of a gasoline pump meter in a filling station.

When the miniature car 1 is lifted after the micromotor 35 stops, the supporting arm 33 moves upward by the action of the formed wire spring 38, and the housing 34 also moves upward. With the upward movement of the housing 34, the worm gear 50 is disengaged from the gear 51. A coil spring provided on the shaft of the gear 51 is wound while the gear 51 is rotated in mesh with the worm gear 50. The energy stored in the coil spring 62 causes the gear 51 to rest to its initial state immediately after the gear 51 is disengaged from the worm gear 50. At the same time, the lever 52 is returned to its initial state, preparing to perform its function as a timer switch when the micromotor 35 is energized again.

The rotating time of the micromotor 35 can be set to the optimum level according to the number of stages of rubber bands and the number of rubber bands provided in the miniature car.

This invention of course is not limited only to the pressure actuated contact mechanism as described above as a means to start the micromotor, but can use a mere switch and other appropriate means. The timer switch mechanism is also limited to the above-mentioned embodiment. For the prime mover of the rollers, not only the micromotor but also other rotating device can be used.

As described above, this invention makes it possible to automatically rotate the tiny wheels of a miniature car by means of rollers instead of rotating the wheels by hand, making it easy to store energy in the energy storage device of a miniature car.

Furthermore, a time function incorporated in the energy supply device of this invention makes it possible to effectively prevent rubber bands from being excessively wound to breakage.

What is claimed is:

1. A toy energy supply device for supplying energy to an elasticity power toy in which energy is stored by twisting an elastic material comprising a power unit, rollers rotated by the power unit, an energizing means for energizing the power unit in a state when the elasticity power toy is placed in contact with the rollers, a roller stop mechanism for stopping the rotation of the rollers when the rollers rotate a predetermined amount, and characterized in that a predetermined amount of energy is stored in the elasticity power toy by means of the roller stop mechanism in a state when the elasticity power toy is placed in contact with the rollers.

2. A toy energy supply device set forth in claim 1 wherein the energizing means consists of an electric energizing circuit to a small electric motor, comprising a support portion for pivotally supporting the rollers and a switch functioning in response to the swinging of the support portion, and characterized in that the switch is actuated in a state when the elasticity power toy is placed in contact with the rollers.

3. A toy energy supply device set forth in claim 2 wherein the roller stop mechanism has a movable contact which pivots, and characterized in that the electric energizing circuit is turned off by means of the movable contact.

* * * * *